US005789344A

United States Patent [19]

Kung et al.

[11] Patent Number: 5,789,344

[45] Date of Patent: Aug. 4, 1998

[54] THERMAL DYE TRANSFER ASSEMBLAGE WITH LOW TG POLYMERIC RECEIVER MIXTURE

[75] Inventors: Teh-Ming Kung; Kristine B. Lawrence, both of Rochester; Wayne A. Bowman, Walworth; William H. Simpson, Pittsford, all of N.Y.

[73] Assignee: Eastman Kodak Company, Rochester, N.Y.

[21] Appl. No.: 878,951

[22] Filed: Jun. 19, 1997

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/500, 913, 914; 503/227

[56] References Cited

U.S. PATENT DOCUMENTS 5,627,128 5/1997 Bowman et al. ..... 503/227

*Primary Examiner*—Bruce H. Hess

*Attorney, Agent, or Firm*—Harold E. Cole

[57] ABSTRACT

A thermal dye transfer assemblage comprising:

(I) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of a) an organic polymeric or oligomeric acid which is capable of reprotonating said deprotonated cationic dye;

b) a polymer having a Tg of less than about 19° C. and having no or only slight acidity; and c) a monomeric, multifunctional organic acid with at least two acid groups attached.

14 Claims, No Drawings

THERMAL DYE TRANSFER ASSEMBLAGE WITH LOW TG POLYMERIC RECEIVER MIXTURE

Reference is made to commonly-assigned U.S. patent application Ser. Nos. 08/878,924, filed concurrently herewith, entitled "Assemblage for Thermal Dye Transfer" by Bowman et al; 08/878,717, filed concurrently herewith, entitled "Thermal Dye Transfer Assemblage With Low Tg Polymeric Receiver Mixture" by Harrison et al; 08/878,564, filed concurrently herewith, entitled "Thermal Dye Transfer Assemblage" by Evans et al; 08/879,061, filed concurrently herewith, entitled "Assemblage for Thermal Dye Transfer" by Guistina et al; and 08/878,565, filed concurrently herewith, entitled "Thermal Dye Transfer Assemblage With Low Tg Polymeric Receiver Mixture" by Lawrence et al, the teachings of which are incorporated herein by reference.

FIELD OF THE INVENTION

This invention relates to a thermal dye transfer receiver element of a thermal dye transfer assemblage and, more particularly, to a polymeric dye image-receiving layer containing a mixture of materials capable of reprotonating a deprotonated cationic dye transferred to the receiver from a suitable donor.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye-receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders such as poly(vinyl chloride), a problem generally referred to as "retransfer".

Commonly used dyes are nonionic in character because of the easy thermal transfer achievable with this type of compound. The dye-receiver layer usually comprises an organic polymer with polar groups to act as a mordant for the dyes transferred to it. A disadvantage of such a system is that, since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

In one type of thermal dye transfer printing, deprotonated nonionic dyes may be transferred to an acid-containing receiver where a reprotonation process may take place to convert the dyes to their protonated form by interaction with the acid moiety in the dye-receiving layer. The dyes are thus rendered cationic. As a consequence, the transferred dyes are anchored in the receiving layer and form a strong electrostatic bond. The reprotonation reaction also causes a hue shift of the transferred dyes from their deprotonated form to their protonated form. In a practical sense, it is always desirable to complete this protonation process as fast as possible, at a rate known as the "dye conversion rate".

DESCRIPTION OF RELATED ART

U.S. Pat. No. 5,627,128 relates to the transfer of a deprotonated cationic dye to a polymeric dye image-receiving layer comprising a mixture of an organic polymeric or oligomeric acid which is capable of reprotonating the deprotonated cationic dye and a polymer having a Tg of less than about 19° C. and having no or only slight acidity. There is a problem with this polymer mixture in that the rate of reprotonation of the deprotonated cationic dyes is not as fast as one would like it to be.

It is an object of this invention to provide a thermal dye transfer assemblage which will reprotonate a deprotonated cationic dye transferred to the receiver element of the assemblage. It is another object of the invention to provide a thermal dye transfer assemblage which has a receiver with an improved dye conversion rate.

SUMMARY OF THE INVENTION

These and other objects are achieved in accordance with this invention which relates to a thermal dye transfer assemblage comprising:

(I) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of a) an organic polymeric or oligomeric acid which is capable of reprotonating said deprotonated cationic dye;

b) a polymer having a Tg of less than about 19° C. and having no or only slight acidity; and c) a monomeric, multifunctional organic acid with at least two acid groups attached.

DESCRIPTION OF THE PREFERRED EMBODIMENTS

It was found that the addition of a monomeric, multifunctional organic acid to an acid-containing receiver for reprotonation of a deprotonated nonionic dye substantially improves the dye conversion rate in comparison with receivers not containing such addendum.

The polymer having a Tg of less than about 19° C. employed in the invention may contain groups which are slightly acidic to improve water dispersibility. However, these acid groups are generally insufficient to protonate the dye.

Deprotonated cationic dyes useful in the invention which are capable of being reprotonated to a cationic dye having a N—H group which is part of a conjugated system are described in U.S. Pat. No. 5,523,274, the disclosure of which is hereby incorporated by reference.

In a preferred embodiment of the invention, the deprotonated cationic dye employed in the invention and the corresponding cationic dye having a N—H group which is part of a conjugated system have the following structures:

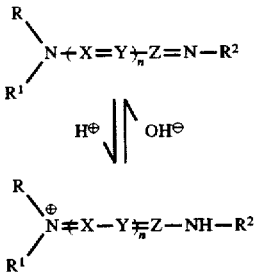

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents a substituted or unsubstituted phenyl or naphthyl group or a substituted or unsubstituted alkyl group from about 1 to about 10 carbon atoms; and n is an integer of from 0 to 11.

The deprotonated cationic dyes according to the above formula are disclosed in U.S. Pat. Nos. 4,880,769, 4,137,042 and 5,559,076, and in K. Venkataraman ed., *The Chemistry of Synthetic Dyes*, Vol. IV, p. 161, Academic Press, 1971, the disclosures of which are hereby incorporated by reference. Specific examples of such dyes include the following (the λ max values and color descriptions in parentheses refer to the dye in its protonated form):

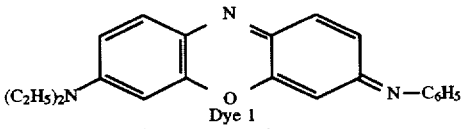

Dye 1
λmax 556 nm (641 nm)
magenta (cyan)
U.S. Pat. No. 4,880,769 (Dye 1)

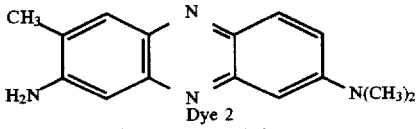

Dye 2
λmax 459 nm (536 nm)
yellow (magenta)

-continued

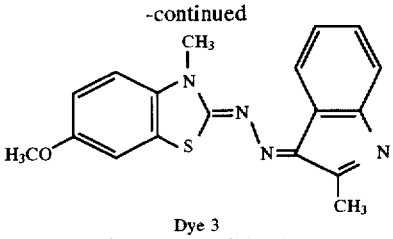

Dye 3
λmax 459 nm (522 nm)
yellow (magenta)

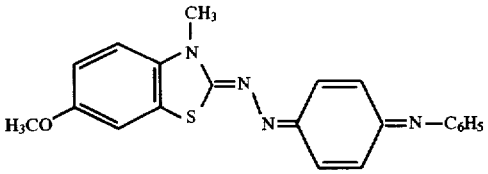

Dye 4
λmax 503 nm (621 nm)
red (blue)

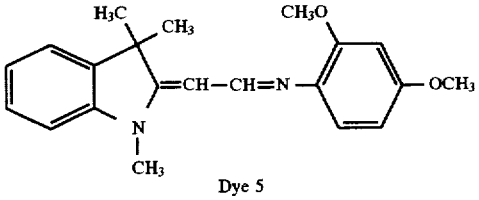

Dye 5
λmax 379 nm (405 nm)
yellow (yellow)

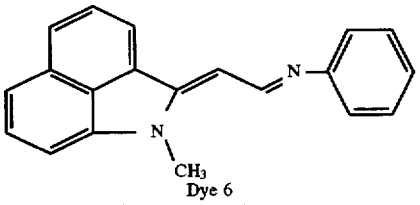

Dye 6
λmax 479 nm (513 nm)
yellow (magenta)

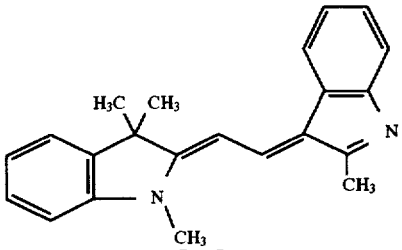

Dye 7
λmax 485 nm (495)
yellow (yellow)

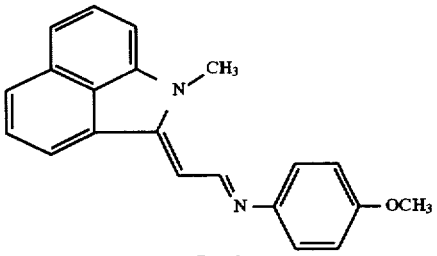

Dye 8
yellow (magenta)
U.S. Pat. No. 5,559,076 (dye precursor 5)

The dyes described above may be employed in any amount effective for the intended purpose. In general, good results have been obtained when the dye is present in an amount of from about 0.05 to about 1.0 g/m$^2$, preferably from about 0.1 to about 0.5 g/m$^2$. Dye mixtures may also be used.

The polymeric or oligomeric acid source used in the invention can be any polymer or oligomer which contains an acid group such as a sulfonic acid, phosphoric acid or carboxylic acid which is capable of protonating the dye. It may be used in an amount of from about 0.05 g/m$^2$ to about 20 g/m$^2$.

Following are examples of polymeric or oligomeric acid sources that can be used for protonating the dyes in accordance with the invention.

| | |
|---|---|
| Polymer A-1 | poly[isophthalic acid-co-5-sulfoisophthalic acid (90:10 molar ratio)-diethylene glycol (100 molar ratio)], Mw = 20,000 (sulfonic acid of AQ29, Eastman Chemical Co.) |
| Polymer A-2 | poly(2-acrylamido-2-methyl-propanesulfonic acid) |
| Polymer A-3 | poly(vinylsulfonic acid) |
| Polymer A-4 | poly(ethylene-co-vinylsulfuric acid) 61:39 wt (vinyl sulfate) |
| Oligomer A-5 | poly[isophthalic acid-co-5-sulfoisophthalic acid (90:10 molar ratio)-diethylene glycol (100 molar ratio)], Mw = 4,765 |

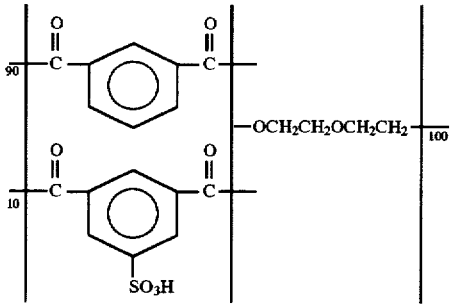

| | |
|---|---|
| Oligomer A-6 | alternating copolymer of maleimide and 2-methyl-2-propanesulfonic acid Mw = 2,790 (U.S. Pat. No. 5,733,846) |

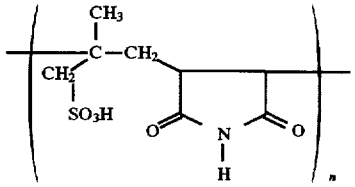

Any type of polymer may be employed in the receiver of the invention, e.g., condensation polymers such as polyesters, polyurethanes, polycarbonates, etc.; addition polymers such as polystyrenes, vinyl polymers, acrylic polymers, etc.; block copolymers containing large segments of more than one type of polymer covalently linked together, provided such polymeric material has the low Tg as described above. In a preferred embodiment of the invention, the dye image-receiving layer comprises an acrylic polymer, a styrene polymer or a vinyl polymer. These polymers may be employed at a concentration of from about 0.05 g/m$^2$ to about 20 g/m$^2$.

Following are examples of low Tg polymers that may be used in the invention:

Polymer P-1: poly(butyl acrylate-co-allyl methacrylate) 98:2 wt core/poly(glycidyl methacrylate) 10 wt shell, (Tg=−40° C.)

Polymer P-2: poly(butyl acrylate-co-allyl methacrylate) 98:2 wt core/poly(ethyl methacrylate) 30 wt shell, (Tg=−41° C.)

Polymer P-3: poly(butyl acrylate-co-allyl methacrylate) 98:2 wt core/poly(2-hydroxypropyl methacrylate) 10 wt shell, (Tg=−40° C.)

Polymer P-4: poly(butyl acrylate-co-ethylene glycol dimethacrylate) 98:2 wt core/poly(glycidyl methacrylate) 10 wt shell, (Tg=−42° C.)

Polymer P-5: poly(butyl acrylate-co-allyl methacrylate-co-glycidyl methacrylate) 89:2:9 wt, (Tg=−34° C.)

Polymer P-6: poly(butyl acrylate-co-ethylene glycol dimethacrylate-co-glycidyl methacrylate) 89:2:9 wt (Tg=−28° C.)

Polymer P-7: poly(butyl methacrylate-co-butyl acrylate-co-allyl methacrylate) 49:49:2 wt core/poly(glycidyl methacrylate) 10 wt shell, (Tg=−18° C.)

Polymer P-8: poly(methyl methacrylate-co-butyl acrylate-co-2-hydroxyethyl methacrylate-co-2-sulfoethylmethacrylate sodium salt) 30:50:10:10 wt, (Tg=−3° C.)

Polymer P-9: poly(methyl methacrylate-co-butyl acrylate-co-2-hydroxyethyl methacrylate-co-styrenesulfonic acid sodium salt) 40:40:10:10 wt, (Tg=0° C.)

Polymer P-10: poly(methyl methacrylate-co-butyl acrylate-co-2-sulfoethyl methacrylate sodium salt-co-ethylene glycol dimethacrylate) 44:44:10:2 wt, (Tg=14° C.)

Polymer P-11: poly(butyl acrylate-co-Zonyl TM®-co-2-acrylamido-2-methyl-propanesulfonic acid sodium salt) 50:45:5 wt (Tg=−39° C.) (Zonyl TM® is a monomer from the DuPont Company)

Polymer P-12: XU31066.50 (experimental polymer based on a styrene butadiene copolymer from Dow Chemical Company) (Tg=−31° C.)

Polymer P-13: AC540® nonionic emulsion (Allied Signal Co.) (Tg=−55° C.)

The polymer in the dye image-receiving layer may be present in any amount which is effective for its intended purpose. In general, good results have been obtained at a concentration of from about 0.5 to about 20 g/m$^2$. The polymers may be coated from organic solvents or water, if desired.

The monomeric, multifunctional organic acid employed in the invention may be aliphatic, alicyclic or aromatic. In a preferred embodiment, the monomeric, multifunctional organic acid is succinic acid. The monomeric, multifunctional organic acid employed in the invention may be employed in any amount effective for the intended purpose. In general, good results have been obtained when the monomeric, multifunctional organic acid is present in an amount of from about 0.01 to about 2.0 g/m$^2$, preferably from about 0.02 to about 0.16 g/m$^2$.

Specific examples of monomeric, multifunctional organic acids useful in the invention include the following:

M-1 oxalic acid, MW=90.03, Eastman Fine Chemicals

M-2 malonic acid, MW=104.06, Eastman Fine Chemicals

M-3 succinic acid, MW=118.09, Acros Chemical

M-4 glutaric acid, MW=132.12, Eastman Fine Chemicals

M-5 adipic acid, MW=146.16, Eastman Fine Chemicals

M-6 maleic acid, MW=116.07, Eastman Fine Chemicals

M-7 1,1,2-dodecanetricarboxylic acid, MW=302.4

M-8 dodecylpropanedioic acid, MW=272.4

M-9 2-(phenylmethyl)-dodecylpropanedioic acid, MW=362.5

M-10 tricarballylic acid, MW=176.12, Aldrich Chemical Co.

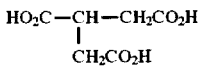

M-11 citric acid, MW=192.13.

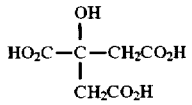

M-12 trans-aconitic acid, MW=174.1

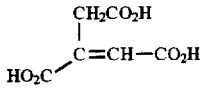

M-13 tetrahydrofuran-tetracarboxylic acid, MW=248.15

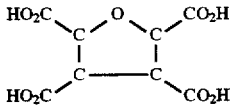

M-14 1,2,4-benzenetricarboxylic acid, MW=210.14, Aldrich Chemical Co.

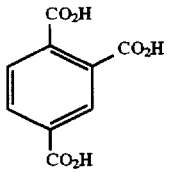

M-15 1,2,4,5-benzenetetracarboxylic acid, MW=254.15, Aldrich Chemical Co.

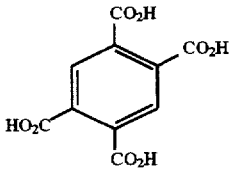

M-16 1,5-naphthalenedisulfonic acid, tetrahydrate, MW=360.36, Aldrich Chemical Co.

M-17 5-sulfosalicylic acid, dihydrate, MW=254.21, Eastman Fine Chemicals

M-18 4-sulfophthalic acid, MW=246.19, Eastman Fine Chemicals

M-19 alkylated diphenyloxy-disulfonic acid (converted from DOWFAX® 2A1 sodium disulfonate surfactant, Dow Chemical Co.) Avg. MW=525

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal print head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

Dye-Donor Elements

Individual dye-donor elements were prepared by coating the following compositions in the order listed on a 6 μm poly(ethylene terephthalate) support:

1) a subbing layer of Tyzor TBT®, a titanium tetrabutoxide, (DuPont Company) (0.13 g/m$^2$) coated from 1-butanol/propyl acetate (15/85 wt %); and
2) an imaging dye layer coated from a tetrahydrofuran/cylopentanone (95/5) solvent mixture, whereby two different binder polymer mixtures with the selected dye as shown in Table 1 were used:
   DB-1 propionate ester of bisphenol A copolymer with epichlorohydrin (prepared by techniques similar to those described in U.S. Pat. No. 5,244,862);
   DB-2 poly(butyl methacrylate-co-Zonyl TM®) (75/25) where Zonyl TM® is a perfluoro monomer available from DuPont.

Details of dye and binder laydowns are summarized in the following Table 1:

TABLE 1

| Dye-Donor Element | Deprotonated Dye | Dye Laydown, (g/m$^2$) | DB-1 Laydown, (g/m$^2$) | DB-2 Laydown, (g/m$^2$) |
|---|---|---|---|---|
| Yellow | Dye 5 | 0.28 | 0.27 | 0.07 |
| Cyan | Dye 1 | 0.15 | 0.18 | 0.05 |

On the back side of the dye-donor element were coated the following compositions in the order listed:

1) a subbing layer of Tyzor TBT®, a titanium tetrabutoxide, (DuPont Company) (0.13 g/m$^2$) coated from 1-butanol/propyl acetate (15/85 wt %); and
2) a slipping layer of 0.38 g/m$^2$ poly(vinyl acetal) (Sekisui), 0.022 g/m$^2$ Candelilla wax dispersion (7% in methanol), 0.012 g/m$^2$ PS513 amino-terminated polydimethylsiloxane (Huels) and 0.0003 g/m$^2$ p-toluenesulfonic acid coated from a 3-pentanone/distilled water (98/2) solvent mixture.

Dye Receiving Elements

Dye receiving elements were prepared by first extrusion-laminating a paper core with a 38 μm thick microvoided composite film (OPPalyte® 350TW, Mobil Chemical Co.) as disclosed in U.S. Pat. No. 5,244,861.

A subbing layer coating solution was then prepared by dissolving Prosil® 221 and Prosil® 2210 (PCR Corp.) (each at 0.055 g/m$^2$) which are amino- and epoxy-functional organo-oxysilanes, respectively, in an ethanol/methanol/water solvent mixture. The resulting solution contained approximately 1% silane component, 1% water, and 98% 3A alcohol.

The composite film side of the above laminate was then coated with the above subbing layer solution at a total dry coverage of 0.11 g/m$^2$. Prior to coating, the support had been subjected to a corona discharge treatment at approximately 450 joules/m$^2$.

The receiving elements were then coated with dye-receiving layers as described below.

Control Receiver Element C-1:

The dye-receiving layer was composed of a mixture of 2.750 g/m$^2$ of Polymer A-1 and 2.750 g/m$^2$ of polymer P-1 coated from distilled water.

Receiver Elements E-1 through E-6:

These were prepared as described above for control receiver element C-1, except the dye-receiving layer contained dicarboxylic acid addenda M-1 through M-6. The dicarboxylic acid addenda were added at equal molar amounts based on their respective molecular weights. The dry laydowns for A-1, P-1 and acid addenda M-1 through M-6 are summarized in Table 2.

TABLE 2

| Receiver Element | Acid Source (g/m$^2$) | A-1 (g/m$^2$) | P-1 (g/m$^2$) |
|---|---|---|---|
| E-1 | M-1 (0.056) | 2.75 | 2.70 |
| E-2 | M-2 (0.064) | 2.75 | 2.69 |
| E-3 | M-3 (0.073) | 2.75 | 2.68 |
| E-4 | M-4 (0.080) | 2.75 | 2.67 |
| E-5 | M-5 (0.089) | 2.75 | 2.66 |
| E-6 | M-6 (0.070) | 2.75 | 2.68 |
| C-1 | none | 2.75 | 2.75 |

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head TDK Model No. L-231, resolution of 5.4 dots/mm, thermostated at 25° C. was pressed with a force of 24.4 Newton (2.5 kg) against the dye-donor element side of the assemblage, pushing it against the rubber roller.

The imaging electronics were activated causing the donor-receiver assemblage to be drawn through the print head/roller nip at 38.3 mm/sec. Coincidentally, the resistive elements in the thermal print head were pulsed for 127.75 μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal head was approximately 12.0 volts resulting in an instantaneous peak power of 0.289 watts/dot and a maximum total energy of 1.18 mJ/dot. This procedure was done using the yellow dye-donor element and then repeated on a portion of the yellow image with the cyan dye-donor element to produce a green stepped image. The print room humidity was 44% RH.

For images containing a cyan dye (cyan or green images), protonation causes a color change from the deprotonated dye form (magenta) to the protonated dye form (cyan). This color change can be monitored by measuring Status A red (cyan) and green (magenta) densities and calculating a red/green ratio as a function of time.

After printing, the dye-donor element was separated from the imaged receiving element and the Status A reflection red and green densities at step 10 in the stepped-image were measured for the green image using an X-Rite 820® reflection densitometer after 1 and 5 minutes at room temperature. The prints were then placed into a 50° C./50% RH oven for 3 hours and the red and green densities were reread. A red/green (R/G) ratio (minus the baseline) was calculated for the green image in each receiver at the above mentioned time intervals and the % dye conversion for the cyan dye in the green image was calculated assuming the incubated R/G ratios represented 100% dye conversion.

For images containing a cyan dye (cyan or green image), the rate of protonation is proportional to the rate of hue shift from the deprotonated cyan dye form (magenta) to the protonated cyan dye form (cyan). This hue shift can be monitored by measuring Status A red (cyan) and green (magenta) densities at various time intervals and calculating the red/green ratio for each time interval. Complete protonation (conversion) of the cyan dye was equivalent to the red/green ratio after incubating prints at 50° C./50% RH for 3 hours, and a % dye conversion could be calculated. The results are summarized in Table 3 below.

TABLE 3

| Receiver Element | Acid Source | R/G Ratio 1 Min. r.t.[1] | R/G Ratio 5 Min. r.t.[1] | R/G Ratio 3 Hrs. inc.[2] | % Dye Conv. 1 Min.[3] | % Dye Conv. 5 Min.[4] |
|---|---|---|---|---|---|---|
| E-1 | M-1 | 2.53 | 3.27 | 5.65 | 45% | 58% |
| E-2 | M-2 | 3.73 | 5.05 | 5.68 | 66% | 89% |
| E-3 | M-3 | 4.45 | 5.21 | 5.63 | 79% | 93% |
| E-4 | M-4 | 3.46 | 5.05 | 5.67 | 61% | 89% |
| E-5 | M-5 | 3.15 | 5.06 | 5.76 | 55% | 88% |
| E-6 | M-6 | 3.59 | 5.05 | 5.79 | 62% | 87% |
| C-1 | none | 2.02 | 2.59 | 5.84 | 35% | 44% |

[1]calculated red/green ratio for green image after 1 and 5 minutes at room temperature
[2]calculated red/green ratio for green image after 3 hours incubation at 50° C./50% RH
[3][(R/G ratio, 1 min., room temperature)/(R/G ratio, 3 hrs. incubation)] × 100 for green image
[4][(R/G ratio, 5 min., room temperature)/(R/G ratio, 3 hrs. incubation)] × 100 for green image The above results show that the addition of dicarboxylic acids M-1 through M-6 to the dye-receiving layer shown in receiver elements E-1 through E-6 improves the dye conversion rate (or % of dye conversion after specified time intervals of 1 and 5 minutes) as compared to the control receiver C-1 without any added dicarboxylic acid.

Example 2

Dye-Receiving Elements E-7 through E-10

These elements were prepared as described above for Receiver Element E-3 in Example 1, except the level of dicarboxylic acid addendum M-3 was varied from 0.02 g/m$^2$ to 0.15 g/m$^2$ keeping the final dry laydown constant at 5.5 g/m$^2$. The dry laydowns for M-3, A-1 and P-1 are summarized in Table 4 below.

Thermal dye transfer prints were prepared using Receiver Elements E-7 through E-10 and evaluated as described in Example 1 with the following results:

TABLE 4

| Receiver Element | M-3 (g/m$^2$) | A-1 (g/m$^2$) | P-1 (g/m$^2$) | % Dye Conv. 5.0 Min.[1] |
|---|---|---|---|---|
| E-7 | 0.02 | 2.75 | 2.73 | 51% |
| E-8 | 0.07 | 2.75 | 2.68 | 87% |
| E-9 | 0.11 | 2.75 | 2.64 | 89% |
| E-10 | 0.15 | 2.75 | 2.60 | 85% |
| C-1 | none | 2.75 | 2.75 | 44% |

[1][(R/G ratio, 5 min., room temperature)/(R/G ratio, 3 hrs. incubation)] × 100 for green image The above results show that the addition of succinic acid, M-3, to the receiver improves the dye conversion rate relative to the control C-1 which did not contain succinic acid.

Example 3

Preparation of Dye-Receiver Elements

Dye Receiver Elements C-2 through C-7

These elements were prepared as described above for control receiver element C-1 in Example 1, except the dye-receiving layer was composed of a mixture of acid sources A-1 through A-6, P-1 polymer, and 0.022 g/m$^2$ of a fluorocarbon surfactant (Fluorad FC-170C®, 3M Corporation) coated from distilled water. The dry laydowns for A-1 through A-6 were chosen to provide levels of acidity equivalent to A-1 in control receiver element C-2. The total dry laydown of the mixture was kept constant at 6.73 g/m$^2$. The milliequivalents of titratable protons per gram (meq/gm) of strong acid (—$SO_3H$) and dry laydowns for A-1 through A-6 and dry laydown for P-1 are summarized in Table 5.

TABLE 5

| Receiver Element | Acid Source | Acid Source meq/gm (meas.)[1] | Acid Source (g/m$^2$) | P-1 (g/m$^2$) |
|---|---|---|---|---|
| C-2 | A-1 | 0.39 | 2.69 | 4.04 |
| C-3 | A-2 | 4.83 | 0.22 | 6.51 |
| C-4 | A-3 | 5.71 | 0.18 | 6.54 |
| C-5 | A-4 | 3.13 | 0.33 | 6.39 |
| C-6 | A-5 | 0.40 | 2.69 | 4.04 |
| C-7 | A-6 | 3.32 | 0.32 | 6.40 |

[1]milliequivalents of titratable protons per gram of material

Receiver Elements E-11 through E-16

These elements were prepared the same as Control Receiver Elements C-2 through C-7, except the dye-receiving layer was composed of a mixture of acid sources A-1 through A-6, P-1 polymer, 0.11 g/m$^2$ of succinic acid, M-3, and 0.022 g/m$^2$ of a fluorocarbon surfactant Fluorad FC-170C®. The level of P-1 polymer was adjusted to keep the dry laydown of the final mixture constant at 6.73 g/m$^2$. The dry laydowns for A-1 through A-6 and P-1 are summarized in Table 6.

TABLE 6

| Receiver Element | Acid Source (g/m$^2$) | P-1 (g/m$^2$) |
|---|---|---|
| E11 | A-1 (2.69) | 3.93 |
| E12 | A-2 (0.22) | 6.40 |
| E13 | A-3 (0.18) | 6.44 |
| E14 | A-4 (0.33) | 6.29 |
| E15 | A-5 (2.69) | 3.93 |
| E16 | A-6 (0.32) | 6.30 |

Thermal dye transfer prints were prepared and evaluated as described in Example 1, except the voltage supplied to the thermal head was approximately 13 volts resulting in an instantaneous peak power of 0.318 watts/dot and a maximum total energy of 1.42 mJ/dot. In addition, the print room humidity was 44% RH and the % dye conversion for the cyan dye in the green image was determined for 5 minutes only. The results are summarized in Table 7.

TABLE 7

| Receiver Element | Acid Source | R/G Ratio, 5 Min. r.t.[1] | R/G Ratio, 3 Hours inc.[2] | % Dye Conv., 5 Min.[3] |
|---|---|---|---|---|
| E-11 | A-1 | 3.88 | 5.64 | 69% |
| E-12 | A-2 | 4.03 | 4.68 | 86% |
| E-13 | A-3 | 3.88 | 4.80 | 81% |
| E-14 | A-4 | 3.53 | 4.19 | 84% |

TABLE 7-continued

| Receiver Element | Acid Source | R/G Ratio, 5 Min. r.t.[1] | R/G Ratio, 3 Hours inc.[2] | % Dye Conv., 5 Min.[3] |
|---|---|---|---|---|
| E-15 | A-5 | 4.19 | 5.26 | 80% |
| E-16 | A-6 | 3.97 | 4.55 | 87% |
| C-2 | A-1 | 2.06 | 5.71 | 36% |
| C-3 | A-2 | 2.53 | 3.25 | 78% |
| C-4 | A-3 | 2.82 | 4.43 | 64% |
| C-5 | A-4 | 3.07 | 4.34 | 71% |
| C-6 | A-5 | 2.76 | 5.68 | 49% |
| C-7 | A-6 | 1.98 | 2.88 | 69% |

[1]calculated red/green ratio for green image after 5 minutes at room temperature
[2]calculated red/green ratio for green image after 3 hours at 50° C./50% RH
[3](R/G Ratio, 5 min., room temperature)/(R/G Ratio, 3 hrs., incubation) × 100 for green image The above results show that the addition of a dicarboxylic acid to a mixture of an organic polymeric acid (A-1 through A-6) and a polymer having a Tg less than 19° C. (Receiver Elements E-11 through E-16) improves the dye conversion rate (or rate of protonation) of deprotonated cationic dyes relative to mixtures that do not contain the multifunctional acid addendum (Control Receiver Elements C2 through C7).

Example 4

Thermal dye transfer prints were prepared and evaluated as in Example 1, except the dye-receiver layers were composed of mixtures of multifunctional acid addenda M-3, M-7 through M-15, polymer P-1, acid source A-1 (2.75 g/m$^2$ for E-9 and E-17 through E-19 and 2.69 g/m$^2$ for E-11 and E-20 through E-25) and 0.022 g/m$^2$ of a fluorocarbon surfactant (Fluorad FC-170C®) (for E-11, E-20 through E-25 only). The meq/gm of acid and dry laydowns for M-3, M-7 through M-15, and dry laydowns for P-1 are summarized in Table 8.

TABLE 8

| Receiver Element | Multifunctional Carboxylic Acid | Multifunctional Carboxylic Acid meq/gm (calc.)[1] | Multifunctional Carboxylic Acid (g/m$^2$) | P-1 laydown, (g/m$^2$) |
|---|---|---|---|---|
| E-9 | M-3 | 8.5 | 0.11 | 2.64 |
| E-17 | M-7 | 3.3 | 0.28 | 2.47 |
| E-18 | M-8 | 3.7 | 0.25 | 2.50 |
| E-19 | M-9 | 2.8 | 0.33 | 2.42 |
| C-1 | none | — | — | 2.75 |
| E-11 | M-3 | 8.5 | 0.11 | 3.93 |
| E-20 | M-10 | 5.7 | 0.16 | 3.88 |
| E-21 | M-11 | 5.2 | 0.17 | 3.86 |
| E-22 | M-12 | 5.7 | 0.16 | 3.88 |
| E-23 | M-13 | 4.0 | 0.23 | 3.81 |
| E-24 | M-14 | 4.8 | 0.19 | 3.84 |
| E-25 | M-15 | 3.9 | 0.24 | 3.80 |
| C-2 | none | — | — | 4.04 |

[1]milliequivalents of titratable protons per gram of material (l/mw × 1000)

The preparation of dye-donor elements and the evaluation of thermal dye transfer images are the same as stated in Example 3. In addition, the print room humidity was 44% RH for receiver elements E-9, E-17 through E-19 and C-1, and 65% RH for receiver elements E-11, E-20 through E-25 and C-2. The % dye conversion for the cyan dye in the green image was determined after 5 minutes. The results are summarized in Table 9 below.

TABLE 9

| Receiver Element | Multifunctional Carboxylic Acid | R/G Ratio, 5.0 Min r.t.[1] | R/G Ratio, 3 Hours, inc.[2] | % Dye Conv., 5.0 Min.[3] |
|---|---|---|---|---|
| E-9 | M-3 | 5.05 | 5.70 | 89% |
| E-17 | M-7 | 3.52 | 5.71 | 62% |
| E-18 | M-8 | 3.85 | 5.85 | 66% |
| E-19 | M-9 | 4.83 | 5.61 | 86% |
| C-1 | none | 2.59 | 5.84 | 44% |
| E-11 | M-3 | 4.69 | 5.41 | 87% |
| E-20 | M-10 | 3.45 | 5.25 | 66% |
| E-21 | M-11 | 3.34 | 5.54 | 60% |
| E-22 | M-12 | 3.42 | 5.25 | 65% |
| E-23 | M-13 | 3.21 | 5.22 | 61% |
| E-24 | M-14 | 3.26 | 5.30 | 62% |
| E-25 | M-15 | 3.29 | 5.38 | 61% |
| C-2 | none | 2.93 | 5.64 | 52% |

[1]calculated red/green ratio for green image after 5 minutes at room temperature
[2]calculated red/green ratio for green image after 3 hours incubation at 50° C./50% RH
[3]|(R/G ratio, 5 min., room temperature)/(R/G ratio, 3 hrs. incubation)| × 100 for green image The above results show that the addition of an aliphatic (M-3, M-7 through M-12), alicyclic (M-13) or aromatic (M-14 through M-15) multifunctional carboxylic acid to a mixture of an organic polymeric acid (A-1) and a polymer having a Tg less than 19° C. (E-9, E-11, E-17 through E-25) improves dye conversion rate (rate of protonation) of deprotonated cationic dyes relative to mixtures that contained no addenda (C-1 and C-2). The highest dye conversion rate (or dye reprotonation rate) was achieved with an aliphatic dicarboxylic acid addendum, succinic acid (M-3).

Example 5

Receiver Elements E-26 through E-29

These elements were prepared as disclosed above for Receiver Elements E-1 through E-6 in Example 1, except multifunctional acid addenda M-16 through M-19 were used in place of M-1 through M-6. The multifunctional acid addenda were added at equal molar amounts based on their respective molecular weights. The level of acid source A-1 was adjusted to keep the dry laydown of the final mixture constant at 5.50 g/m$^2$. Detailed dry laydowns are listed in Table 10 below.

TABLE 10

| Receiver Element | Acid (g/m$^2$) | A-1 (g/m$^2$) | P-1 (g/m$^2$) |
|---|---|---|---|
| E-26 | M-16 (0.34) | 2.41 | 2.75 |
| E-27 | M-17 (0.24) | 2.51 | 2.75 |
| E-28 | M-18 (0.23) | 2.52 | 2.75 |
| E-29 | M-19 (0.49) | 2.26 | 2.75 |
| C-1 | none | 2.75 | 2.75 |

Thermal dye transfer prints were prepared using Receiver Elements E-26 through E-29 and Control Receiver Element C-1 and evaluated as described in Example 1. The following results were obtained:

TABLE 11

| Receiver Element | Acid Source | R/G Ratio 1 Min. r.t. | R/G Ratio 5 Min. r.t. | R/G Ratio 3 Hrs. inc. | % Dye. Conv. 1 Min. | % Dye Conv. 5 Min. |
|---|---|---|---|---|---|---|
| E-26 | M-16 | 3.50 | 3.57 | 4.26 | 82% | 84% |
| E-27 | M-17 | 3.70 | 3.96 | 5.38 | 69% | 74% |
| E-28 | M-18 | 3.24 | 3.45 | 5.45 | 60% | 63% |
| E-29 | M-19 | 2.94 | 3.17 | 5.00 | 59% | 63% |
| C-1 | none | 2.11 | 2.62 | 5.82 | 36% | 45% |

The above results show that the addition of aromatic multifunctional organic acids (M-16 through M-19) can improve dye conversion rates as compared to the control receiver C-1, which does not contain any multifunctional organic acid.

Example 6

Control Receiver Elements C-8 through C-13:

The dye-receiver layers were composed of a mixture of control carboxylic acid addenda CM-1 through CM-6, acid source A-1, polymer P-1, and 0.022 g/m$^2$ of Fluorad FC-170C® surfactant (except C-8 and C-9: no surfactant added). The dry laydowns (g/m$^2$) for CM-1 and CM-6 were determined by matching meq/gm of acid present in the M-3 containing coatings, in Receiver Elements E-9 and E-11 (from Example 4), keeping the final dry laydown of the mixture constant at 5.50 g/m$^2$ for C-8 and C-9 and at 6.73 g/m$^2$ for C-10 through C-13. The meq/gm of acid addenda and dry laydowns for CM-1 through CM-6 and dry laydown for A-1 and P-1 are summarized in Table 12.

TABLE 12

| Receiver Element | Carboxylic Acid | Carboxylic Acid meq/gm (calc.)[1] | Carboxylic Acid (g/m$^2$) | A-1 (g/m$^2$) | P-1 (g/m$^2$) |
|---|---|---|---|---|---|
| C-8 | CM-1 | 13.5 | 0.07 | 2.68 | 2.75 |
| C-9 | CM-2 | 8.6 | 0.11 | 2.64 | 2.75 |
| C-10 | CM-3 | 13.9 | 0.06 | 2.70 | 3.97 |
| C-11 | CM-4 | 12.0 | 0.08 | 2.70 | 3.96 |
| C-12 | CM-5 | 5.0 | 0.18 | 2.70 | 3.85 |
| C-13 | CM-6 | 5.31 | 0.17 | 2.70 | 3.86 |

[1]milliequivalents of titratable protons per gram of material (l/mw × 1000)

Control materials

CM-1 propionic acid, MW=74.08, Eastman Fine Chemicals

CM-2 caproic acid, MW=116.16, Eastman Fine Chemicals

CM-3 acrylic acid, MW=72.06, Eastman Fine Chemicals

CM-4 poly(acrylic acid), Tg=105° C.

CM-5 poly(methyl vinyl ether-co-maleic acid), Mw=93,200, Tg=150° C. Aldrich Chemical Co.

CM-6 poly(methyl vinyl ether-co-maleic acid), Mw=476,000, Tg=155° C. Aldrich Chemical Co.

Dye-donor elements were prepared as in Example 1. Thermal dye transfer prints were prepared and evaluated as in Example 1 for C-8 and C-9. For C-10 through C-13, the voltage supplied to the thermal head was approximately 13 volts (as contrasted to 12 volts for C-8 and C-9) resulting in an instantaneous peak power of 0.318 watts/dot and a maximum total energy of 1.42 mJ/dot.

In addition, the print room relative humidity was 32%, 44% and 65% RH for the receiver element sets: (E-11, C-2, C-10 and C-11), (E-9, C-1, C-8 and C-9), and (E-11, C-2, C-12 and C-13), respectively. The results are summarized in Table 13 below.

TABLE 13

| Receiver Element | Multifunctional Carboxylic Acid | R/G Ratio, 5.0 Min. r.t.[1] | R/G Ratio, 3 Hours, inc.[2] | % Dye Conv. 5.0 Min.[3] |
|---|---|---|---|---|
| E-11 | M-3 | 4.25 | 5.52 | 77% |
| C-2 | none | 1.92 | 5.68 | 34% |
| C-10 | CM-3 | 2.27 | 5.74 | 39% |
| C-11 | CM-4 | 2.11 | 5.71 | 37% |
| E-9 | M-3 | 5.05 | 5.70 | 89% |
| C-1 | none | 2.62 | 5.82 | 45% |
| C-8 | CM-1 | 2.77 | 5.84 | 48% |
| C-9 | CM-2 | 2.73 | 5.89 | 46% |
| E-11 | M-3 | 4.69 | 5.41 | 87% |
| C-2 | none | 2.93 | 5.64 | 52% |
| C-12 | CM-5 | 2.79 | 5.56 | 50% |
| C-13 | CM-6 | 2.54 | 5.52 | 46% |

[1]calculated red/green ratio for green image after 5 minutes at room temperature

[2]calculated red/green ratio for green image after 3 hours at 50° C./50% RH

[3](R/G Ratio, 5 min., room temperature)/(R/G Ratio, 3 hrs., incubation) × 100 for green image The above results show that the addition of a multifunctional carboxylic acid (M-3) to a mixture of an organic polymeric acid and a polymer having a Tg less than 19° C. (E-9 and E-11) improves dye conversion rate (rate of protonation) of deprotonated cationic dyes after printing relative to mixtures that contained either monomeric, monofunctional or polymeric carboxylic acids (CM-1 through CM-6). Also the addition of control monomeric, monofunctional (CM-1, CM-2 and CM-3) or polymeric (CM-4, CM-5 and CM-6) carboxylic acids has either no or only a slight effect on the dye conversion rate as compared to C-1 or C-2, which do not contain any carboxylic acid addendum.

The above results along with the results from Examples 1, 4 and 5, show that only monomeric, multifunctional organic acids can improve the dye conversion rate of the above types of receiver elements comprising a mixture of an organic polymeric acid and a polymer having a Tg of less than 19° C. and being of no or slight acidity.

The invention has been described in detail with particular reference to preferred embodiments thereof, but it will be understood that variations and modifications can be effected within the spirit and scope of the invention.

What is claimed is:

1. A thermal dye transfer assemblage comprising:

(I) a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and (II) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer comprising a mixture of a) an organic polymeric or oligomeric acid which is capable of reprotonating said deprotonated cationic dye;

b) a polymer having a Tg of less than about 19° C. and having no or only slight acidity; and c) a monomeric, multifunctional organic acid with at least two acid groups attached.

2. The assemblage of claim 1 wherein said organic polymeric or oligomeric acid contains a sulfonic acid, phosphoric acid or carboxylic acid.

3. The assemblage of claim 1 wherein said polymer having a Tg of less than about 19° C. is an acrylic polymer, a styrene polymer or a vinyl polymer.

4. The assemblage of claim 1 wherein said deprotonated cationic dye has the following formula:

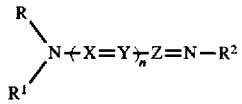

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

5. The assemblage of claim 1 wherein said monomeric, multifunctional organic acid is aliphatic, alicyclic or aromatic.

6. The assemblage of claim 1 wherein said monomeric, multifunctional organic acid is succinic acid.

7. The assemblage of claim 6 wherein said monomeric, multifunctional organic acid is present in an amount of from about 0.01 to about 2.0 g/m$^2$.

8. A process of forming a dye transfer image comprising imagewise-heating a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and imagewise transferring said dye to a dye-receiving element to form said dye transfer image, said dye-receiving element comprising a support having thereon a polymeric dye image-receiving layer, said polymeric dye image-receiving layer comprising a mixture of a) an organic polymeric or oligomeric acid which is capable of reprotonating said deprotonated cationic dye;

b) a polymer having a Tg of less than about 19° C. and having no or only slight acidity; and c) a monomeric, multifunctional organic acid with at least two acid groups attached.

9. The process of claim 8 wherein said organic polymeric or oligomeric acid contains a sulfonic acid, phosphoric acid or carboxylic acid.

10. The process of claim 8 wherein said polymer having a Tg of less than about 19° C. is an acrylic polymer, a styrene polymer or a vinyl polymer.

11. The process of claim 8 wherein said deprotonated cationic dye has the following formula:

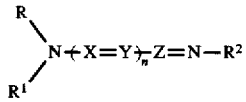

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

12. The process of claim 8 wherein said monomeric, multifunctional organic acid is aliphatic, alicyclic or aromatic.

13. The process of claim 8 wherein said monomeric, multifunctional organic acid is succinic acid.

14. The process of claim 13 wherein said monomeric, multifunctional organic acid is present in an amount of from about 0.01 to about 2.0 g/m$^2$.

* * * * *